United States Patent [19]

Russell

[11] 4,023,473

[45] May 17, 1977

[54] FUME HOOD

[75] Inventor: Walter Russell, West Islip, N.Y.

[73] Assignee: Laboratory Furniture, Inc., Carle Place, N.Y.

[22] Filed: May 6, 1976

[21] Appl. No.: 683,918

[52] U.S. Cl. ..... 98/115 LH; 49/404; 55/DIG. 18

[51] Int. Cl.[2] ..... F23J 11/00

[58] Field of Search ..... 98/115 R, 115 SB, 115 LH; 49/404; 312/214; 55/DIG. 18

[56] References Cited

UNITED STATES PATENTS

| | | | |
|---|---|---|---|
| 2,715,359 | 8/1955 | Mackintosh et al. | 98/115 LH |
| 3,111,077 | 11/1963 | Cortright | 98/115 LH |
| 3,752,056 | 8/1973 | Chamberlin et al. | 98/115 LH |

*Primary Examiner*—Ronald C. Capossela

[57] ABSTRACT

A fume hood is provided having an air intake and an air exhaust communicating with each other through the interior of a fume hood cabinet by way of a by-pass passageway and open front on said cabinet. A plurality of sashes are carried by track means which enable them to move selectively horizontally relative to each other across the open front of the fume hood cabinet to variably open and close the same selectively and relative to the open front. Means connected to the sashes provided for coincidental selective movement therewith to variably close and open the communication of air between the air intake and air exhaust through the by-pass passageway of the fume hood cabinet according to the selective movement of said sashes.

7 Claims, 2 Drawing Figures

FUME HOOD

BACKGROUND OF THE INVENTION

This invention relates to fume hoods utilizing a supplemental air supply and, in particular, to such devices employing horizontally movable sashes.

Fume hoods are conventionally employed in laboratories to contain apparatus and chemicals, particularly those which emit dangerous or noxious fumes. Frequently, legal codes require a face air velocity of the order of 100 feet per minute or greater, which results in the withdrawing of a considerable amount of air from the room in which the hood is located. Since laboratories are generally air conditioned, the waste of the high cost treated air must be kept at a minimum to guard against the high installation costs and operational expenses of heating and air conditioning systems.

To overcome this, it has been the practice to supply such hoods with a supplemental air supply of non-conditioned air. This introduces a complication in that the non-conditioned air must be fed to the fume hood in such a manner as to not affect to any significant degree the conditioned air in the room. Further, the air handling arrangement should advantageously taken into account the fact that a percentage of room air is generally required to be discharged to the atmosphere.

Heretofore, fume hoods have been built which overcome some of the enumerated problems but they have employed vertically moving sashes, which in their open position serve as baffle members. A disadvantage of the vertically moving sashes is that, frequently, apparatus is kept in the hood which require adjustments along a vertical section. For example, the apparatus may be only 1 foot wide by 3 feet high, but, with a conventional vertically movable and operating sash, the same may open some 16 square feet of sash space to permit the operator or technician to adjust the equipment.

By employing a plurality of overlapping horizontally movable sashes a normally 5 feet wide opening is inherently reduced by fifty percent or more permitting a comparable percentage reduction in loss to the building heat and air conditioning system. In research centers that employ hundreds of fume hoods, the savings in energy can be substantial. The design further provides greater protection to the technician, since it can reduce the exposure to operations within the hood to a minimum and permits each horizontal sliding sash to be used as a safety shield.

SUMMARY OF THE INVENTION

A fume hood is provided having an air intake and an air exhaust communicating with each other through the interior of a fume hood cabinet by way of a by-pass passageway and open front on said cabinet. A plurality of sashes are carried by track means which enable them to move selectively horizontally relative to each other across the open front of the fume hood cabinet to variably open and close the same selectively and relative to the open front. Means connected to the sashes provided for coincidental selective movement therewith to variably close and open the communication of air between the air intake and air exhaust through the bypass passageway of the fume hood. cabinet according to the selective movement of said sashes.

Accordingly, it is object of this invention to provide an improved fume hood having horizontally movable sashes.

A further object of this invention is to provide a a fume hood which affords access to a selected vertical section without the necessity of exposing or opening the entire fume hood face.

Still a further object of this invention is to provide a fume hood having means for suspending horizontally slidable sashes, having associated by-passing air guide panels.

Still another object of this invention is to provide a fume hood having a supplementary air plenum and which employs horizontally slidable sashes.

A further object of this invention is to provide a fume hood employing horizontally slidable sashes having air guide panels to prevent outside air from entering the zone outside of the hood face, except where and when a sash section is opened.

The above description, as well as further objects, features and advantages of the present invention, will be more fully appreciated by reference to the following detailed description of a presently preferred, but, nonetheless illustrative, embodiment in accordance with the present invention when taken in conjunction with the accompanying drawings wherein:

DESCRIPTION OF THE PREFERRED EMBODIMENT

Figures 1, 2:
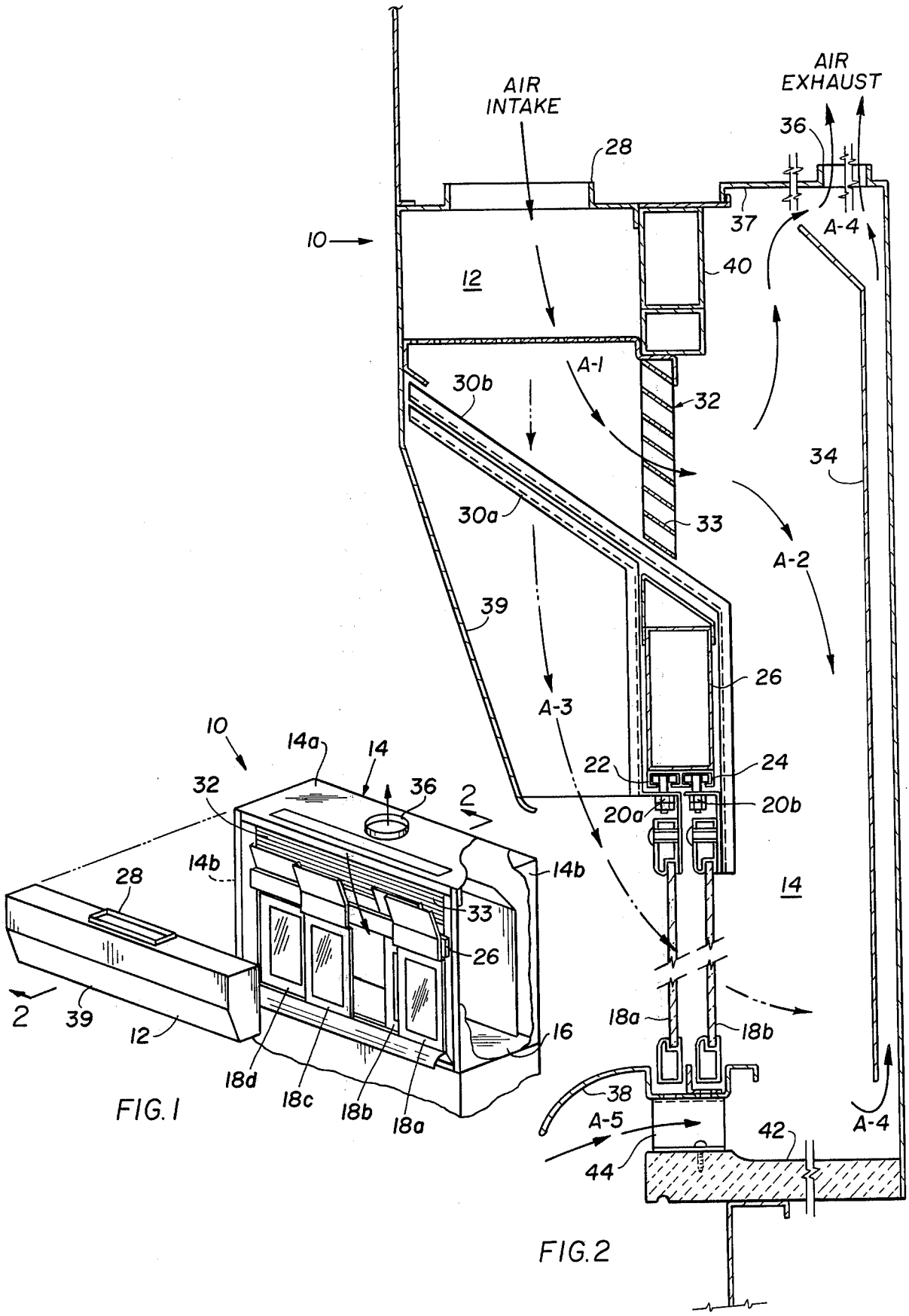
FIG. 1 is an exploded perspective view showing the fume hood of this invention.
FIG. 2 is a side elevational view of the assembled fume hood taken along lines 2—2 of FIG. 1.

Referring now to FIG. 1, the fume hood there shown is generally identified by the numeral 10. As is the practice, the fume hood is provided with an air intake plenum chamber 12 that fits across the front of the fume hood. This chamber 12 is illustrated in FIG. 1 in exploded relationship to the fume hood cabinet 14 that comprises a top **14*a*, sides 14*b*, supported on a bottom or base 16. In the assembled configuration, the air intake plenum 12 is connected to the cabinet 14 as shown in FIG. 2** to become an integral part thereof.

Mounted on the front of the fume hood 10 is a plurality of sliding sashes 18. In the present configuration, four such sashes are shown and they are numbered **18*a*, 18*b*, 18*c* and 18*d* respectively. As the description of the invention proceeds, it will be apparent that any number of tracks with rows of such sashes may be utilized. In the present configuration, the sashes 18 are shown hung in two rows in a sliding bypass relationship. Each sash is supported by two respective hangers 20 and, therefore, the hangers shown are numbered 20*a*, 20*b*, 20*c* and 20*d* with only 20*a* and 20*b* shown in FIG. 2 connected with their respective sashes 18*a* and 18*b*. The hangers 20 are slidably carried by overhead channels 22 and 24 that are supported by a lintel 26.**

A dust collar 28 is positioned above the plenum chamber 12 to provide a coupling to any conventional duct work (not shown) whereby the plenum chamber 12 is adapted to receive a supply of supplemental air from any external source such as atmospheric air. The plenum chamber immediately receives the air supply and directs the flow of air along the face of the cabinet 14 of the fume hood where the air enters the interior of the fume hood substantially under equal pressure throughout.

Each sash 18 is provided with an air guide diverter or panel 30. Thus, each sash 18 will have a respectively numbered diverter panel 30*a*, 30*b*, 30*c* and 30*d*. The diverter panel for each respective sash moves with the sash across the face of the fume hood cabinet 14 to open or close the same. From what has been described, the sash and its respective diverter move in a normally horizontal direction. By reason of the arrangement of the sashes 18, they may be closed alongside each other so as to fully close the face of the cabinet 14 and fume hood 10 to prevent access to the interior of the cabinet by anyone standing in front of the same. In like manner, anyone or more of the sashes 18 may be moved horizontally with respect to any other sash to open a vertically disposed entrance to the fume hood interior.

When the sashes are in their closed relationship across the front of the fume hood cabinet 14, they essentially close off the flow of air from the room into the fume hood interior. The diverters or panels overly each other in the same manner as the sashes 18 overlying each other and, thus, only supplemental air will enter the fume hood by way of the collar 28 and the plenum chamber 12 in the direction depicted by the arrows A-1. This supplemental air flows into the cabinet through a louvered air by-pass 32 that is mounted directly behind the plenum chamber in an air intake opening. The air by-pass louvers 33 guide the flow of air into the hood so as to divert it downward along the inside face of the cabinet 14 behind the panels 30 and the sashes 18 and then along the bottom of the cabinet and finally upward along the back of the cabinet 14. Some air flows upward in the direction of arrows A-4 to flow outward from the cabinet by way of an exhaust collar 36 extending through ceiling portion 37. As is the practice in fume hoods, there is provided a baffle 34 the details of which are only diagrammatically illustrated. The air flowing in the direction A-2 flows downward beneath the lower edge of the baffle 34 and then upward behind it to be exhausted from the cabinet through the air exhaust 36 which may be connected with an exhaust fan and a conventional exhaust duct work, not shown. In this way, there is a complete changeover and flow of air through the fume hood creating an air barrier behind the sashes 18 to prevent noxious fumes that are within the cabinet 14 from flowing outward into the room in which the fume hood is located.

An additional precaution against the entry of such noxious fumes into the surrounding room is to provide a flow of air beneath the sashes into the cabinet 14. This is accomplished by providing an air foil 38 at the bottom of the fume hood beneath the sashes 18. In the same manner as the air guide louvers 32 are supported from a supporting means such as lintel 40, the air foil 38 is supported above a working countertop 42 of the cabinet 14 on a suitably shaped brackets 44 that permit the flow of air into the lower portion of the cabinet beneath the air foil 38 as illustrated by the arrows A-5.

In practice, the room and its contents including the technicians working therein are always protected from the seepage of noxious fumes that may be within the fume hood 10 by reason of the air barrier and air flow that is created within the fume hood as previously described. However, when a technician desires to use the fume hood 10, it is merely necessary for him to slide one of the sashes 18 open in the area wherein he wishes to work within the fume hood. This is illustrated in FIG. 1 wherein the sash 18*b* has been moved ajar behind the sash 18*a* thereby providing the worker an opportunity to manipulate within the fume hood. At such time, by reason of the connection of the air exhaust with the interior of the fume hood at 36, conditioned air within the surrounding room will be drawn into the fume hood cabinet 14 at a minimum constant rate so as not to affect the balance of the building air handling system irrespective of the opening created by the sash 18*b*. The amount of air taken from the room remains constant and is totally irrelevant to the position of the sashes 18*a*, 18*b*, 18*c* and 18*d*. As the air is drawn into the cabinet 14 from about the worker, air is also forced downward from the plenum chamber 12 through the opening created by the diverter 30*b* exposing that portion of the plenum chamber 12 to the front of the fume hood cabinet. Hence, a further air barrier illustrated by the air flow lines A-3 is created in the front of the fume hood to bathe the front of the technician and thereby prevent the outward flow of noxious fumes into the room so that the technician is left unaffected by the fumes of the fume hood interior. Shield 39 acts as an air guide.

It will be recognized that by reason of the overlapping relationship of the diverter panels 30, the plenum chamber 12 is isolated from the front of the fume hood when all of the sashes 18 close the fume hood entrance. However, when any one or more of the sashes 18 are moved to open the fume hood entrance, only that diverter panel which moves with its sash will permit the flow of air downward from the plenum chamber 12 across the front of the fume hood. As a consequence, the front of the fume hood is bathed with outside air which then flows into the fume hood so as to protect the room and its contents from that of the fume hood.

Thus there has been providing a fume hood utilizing horizontal sashes which enables the operator to open only so much of the fume hood as is needed for a particular operation. Air guide panels prevent outside air from entering the room and then flowing into the fume hood. The panels direct the outside air directly into the fume hood in the area where the sashes are in the closed position, thus preventing outside air from mixing with and contaminating the room air. However, where the sash is open, its associated panel permits outside air to flow into the zone outside the hood face and then into the opening of the fume hood to assure that no gases back up into the room from the fume hood. This arrangement assures that outside air will not enter the room when the sash is closed, thus preventing disturbances to the air handling system of the room.

The air guide panels, louvered air by-pass and sashes are compatibly designed to limit the flow of air through the fume hood and, in particular, near the working counter to reasonable velocity values to prevent interference with delicate chemical operations.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. A fume hood comprising:

a bottom counter, a pair of opposed side walls extending upwardly from said bottom counter and a rear wall extending between said side walls upwardly from said bottom counter, a ceiling member extending between said side walls and said rear wall, and an air exhaust means, support means extending between said side walls and spaced from said ceiling member to provide an air intake opening, an air intake plenum positioned opposite the air intake openings, said plenum having a bottom wall comprised of overlapping slidable panels, at least a front and rear parallel track members carried by said support means, slidable hangers supported by said track members, a sufficient number of by-passing sashes supported by said hangers to extend between said side walls in a closed position of said sashes, each of said sashes having associated and movable therewith one of said panels, whereby when said sashes are in a closed position the panels close the bottom of said plenum and air passing through the plenum is directed through the air intake opening into the fume hood and when a given sash is in an open position, its associated panel is in an open position whereby air from the plenum is diverted through the resultant opening in the bottom of the plenum and into the hood through the opening formed by the given open position sash.

2. The fume hood of claim 1 wherein said panels are positioned at an angle so as to extend from the bottom of the air intake opening to substantially the top of the air intake opening.

3. The fume hood of claim 1 wherein those of said sashes carried by slidable hangers supported by said rear track have a portion extending over the said supporting means.

4. In a fume hood having a bottom counter, a pair of opposed side walls extending upwardly from said bottom counter, and a rear wall extending between said side walls upwardly from said bottom counter, a front wall extending between the other ends of said side walls and a ceiling member extending between said side walls and said front and rear walls, an air intake opening extending through the front wall and an air plenum positioned opposite the air intake opening and air exhaust means, the improvement comprising:

a plurality of horizontally slidably movable sashes forming a portion of said front wall, each of said sashes having a solid panel connected thereto for movement therewith, each said panel forming a movable bottom wall portion of said plenum, whereby when said sashes are in a closed position the panels close the bottom of said plenum whereby all air passing through the plenum is directed through the front wall air intake opening into the fume hood and when a given sash is in an open position, its associated panel is in an open position and air from the plenum is diverted through the opening in the bottom of the plenum and into the hood through the opening formed by the given open position sash.

5. The fume hood of claim 4 including track means extending between said side walls and support means supporting each of said sashes for independent sliding movement along said track means.

6. In a fume hood having an air intake and an air exhaust communicating with each other through the interior of a fume hood cabinet by way of an open front on the cabinet and a by-pass through the cabinet, the improvement comprising:

a plurality of sashes movable selectively horizontally relative to each other across the open front of the fume hood cabinet to variably open and close the same selectively, track means on said fume hood on which said sashes are supported for their selective movement relative to the open front, and means between the air intake and the open front and on said sashes for coincidental selective movement therewith to variably close and open the communication of air between the air intake and air exhaust through the open front of the fume hood cabinet and through the by-pass according to the selective movement of said sashes.

7. In a fume hood as in claim 6, said means on said sashes being panels which when they close the communication of air between the air intake and air exhaust through the open front divert air from said intake to said exhaust through said by-pass.

* * * * *